US007997014B2

(12) United States Patent
Righetto

(10) Patent No.: US 7,997,014 B2
(45) Date of Patent: Aug. 16, 2011

(54) ANTISTATIC FOOTWEAR

(75) Inventor: Lucio Righetto, Camponogara (IT)

(73) Assignee: TN & Co. Di Lucio Roghetto, Stra (VE) (IT)

( * ) Notice: Subject to any disclaimer, the term of this patent is extended or adjusted under 35 U.S.C. 154(b) by 973 days.

(21) Appl. No.: 11/570,340

(22) PCT Filed: Jun. 15, 2005

(86) PCT No.: PCT/EP2005/052777

§ 371 (c)(1),
(2), (4) Date: Oct. 9, 2007

(87) PCT Pub. No.: WO2005/122814

PCT Pub. Date: Dec. 29, 2005

(65) Prior Publication Data

US 2008/0134546 A1 Jun. 12, 2008

(30) Foreign Application Priority Data

Jun. 18, 2004 (IT) ..... SV2004A0027

(51) Int. Cl.
*A43B 13/38* (2006.01)
*A43B 13/14* (2006.01)

(52) U.S. Cl. ..... 36/44; 36/30 R; 36/24.5

(58) Field of Classification Search ..... 36/44, 30 R, 36/1, 103, 25 R; 361/224
See application file for complete search history.

(56) References Cited

U.S. PATENT DOCUMENTS

| | | | | | |
|---|---|---|---|---|---|
| 3,296,490 | A * | 1/1967 | Price | 361/223 |
| 3,425,487 | A * | 2/1969 | Tucker | 165/46 |
| 3,898,538 | A * | 8/1975 | Dalton | 361/224 |
| 3,993,932 | A * | 11/1976 | Weigl | 361/224 |
| 4,366,630 | A * | 1/1983 | Bloom | 36/30 R |
| 6,003,247 | A * | 12/1999 | Steffe | 36/45 |
| 6,421,222 | B1 * | 7/2002 | Maritz et al. | 361/224 |
| 7,055,266 | B2 * | 6/2006 | Elsey | 36/30 R |
| 2002/0089805 | A1 | 7/2002 | Maritz et al. | |
| 2002/0112375 | A1 | 8/2002 | Elsey | |

FOREIGN PATENT DOCUMENTS

| | | | |
|---|---|---|---|
| DE | 2147904 | | 3/1973 |
| DE | 3447205 | A1 * | 7/1986 |
| DE | 8437877 | | 11/1986 |
| EP | 1020130 | | 7/2000 |
| FR | 2789274 | | 8/2000 |
| GB | 1463998 | | 2/1977 |

* cited by examiner

*Primary Examiner* — Ted Kavanaugh
(74) *Attorney, Agent, or Firm* — Themis Law

(57) ABSTRACT

Antistatic footwear for man, woman and child comprising an upper portion, an outer sole (3) and an insole (1, 2) disposed between the outer sole (3) and the upper portion. One or more electrical conductors positioned within the outer sole and contacting one or more electrically conductive regions of the insole (1,2) provide an electrical contact between the foot of the user and the ground.

43 Claims, 6 Drawing Sheets

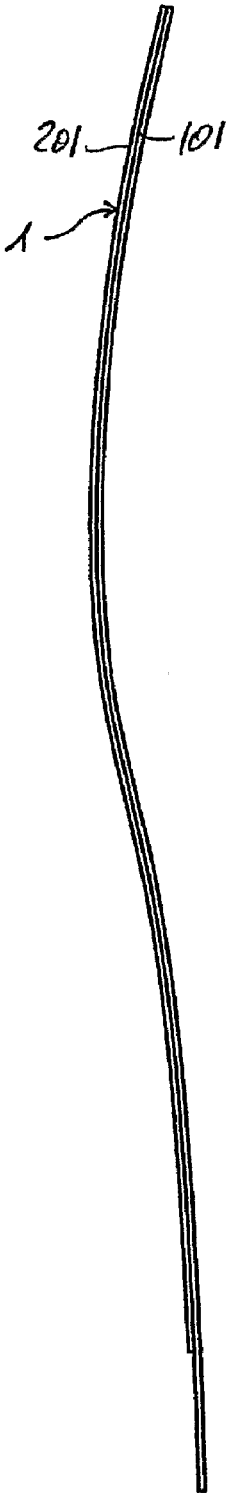
FIG..2
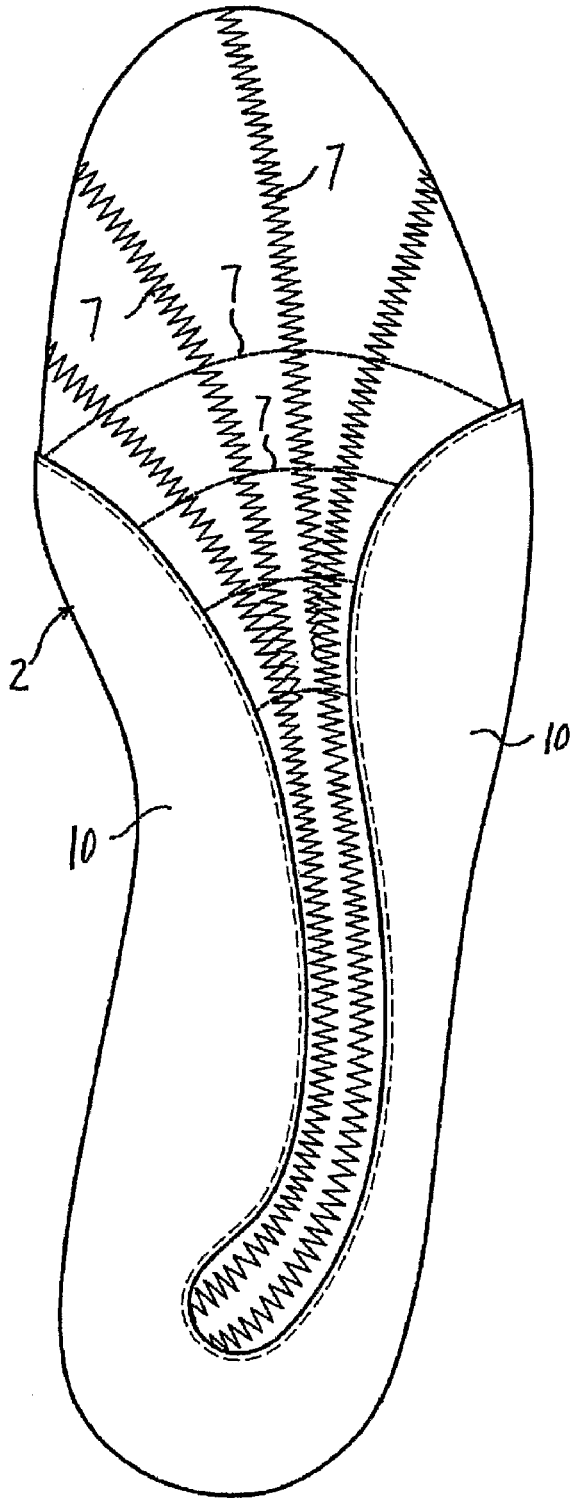
FIG..1

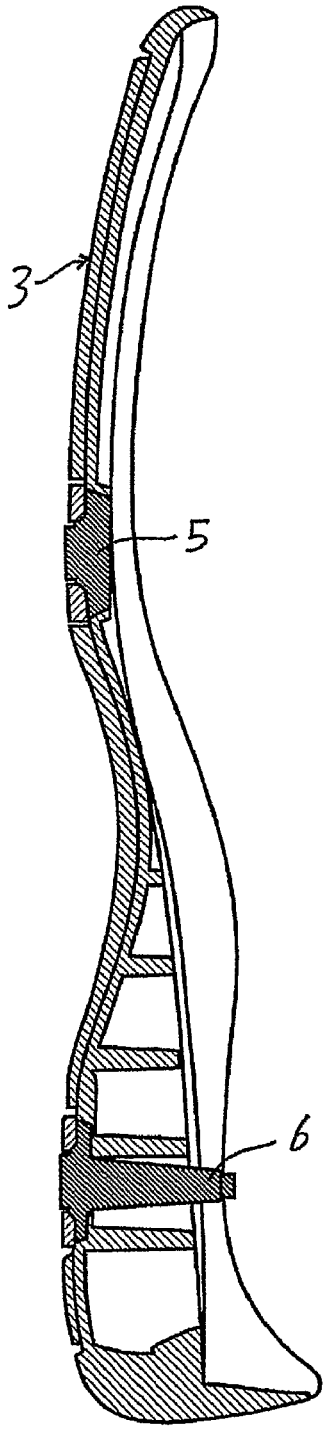
FIG..4
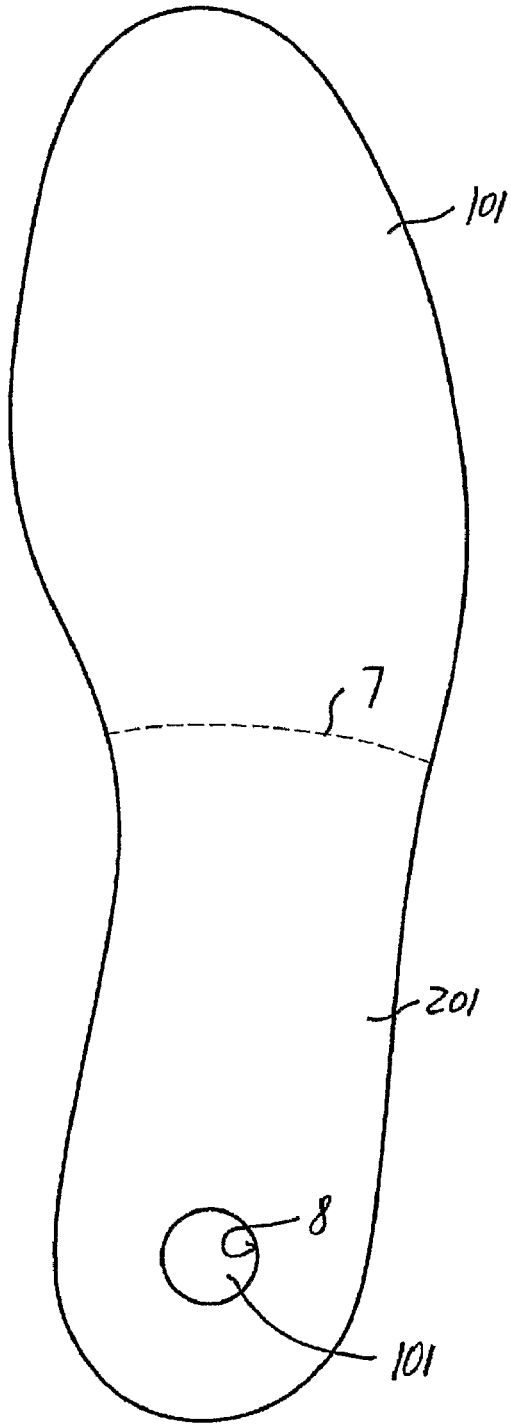
FIG..3

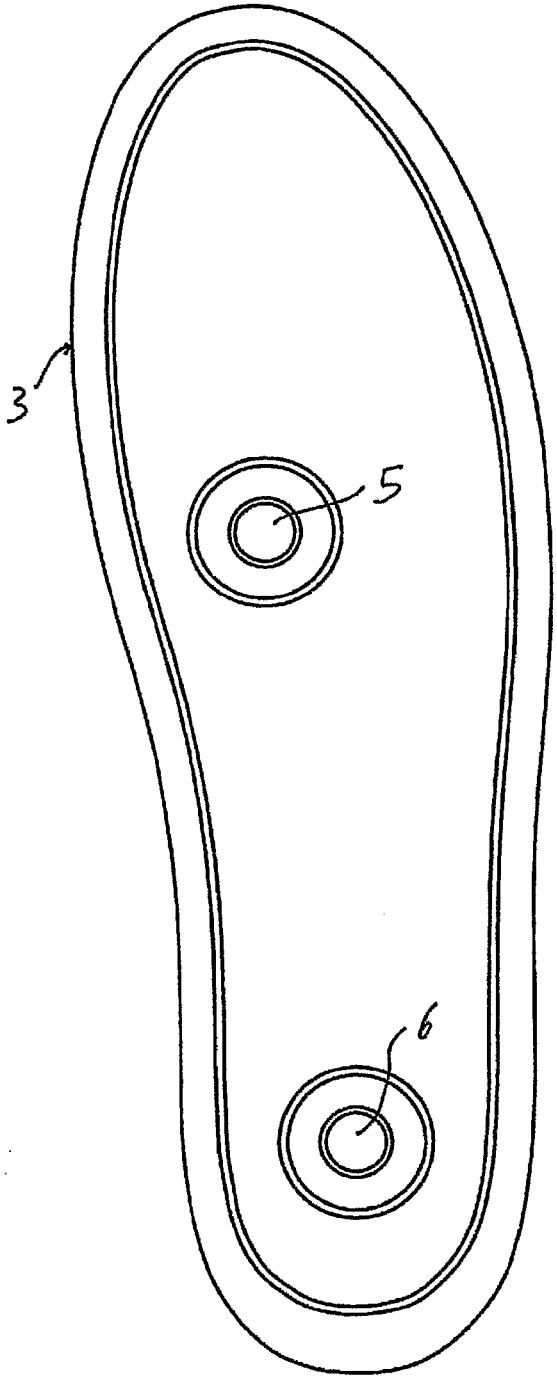
FIG..5
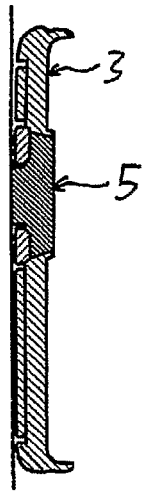
FIG..6
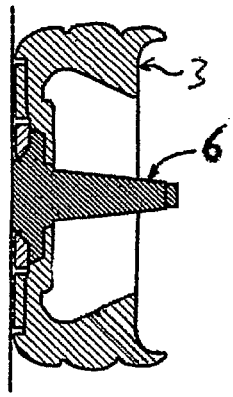
FIG..7

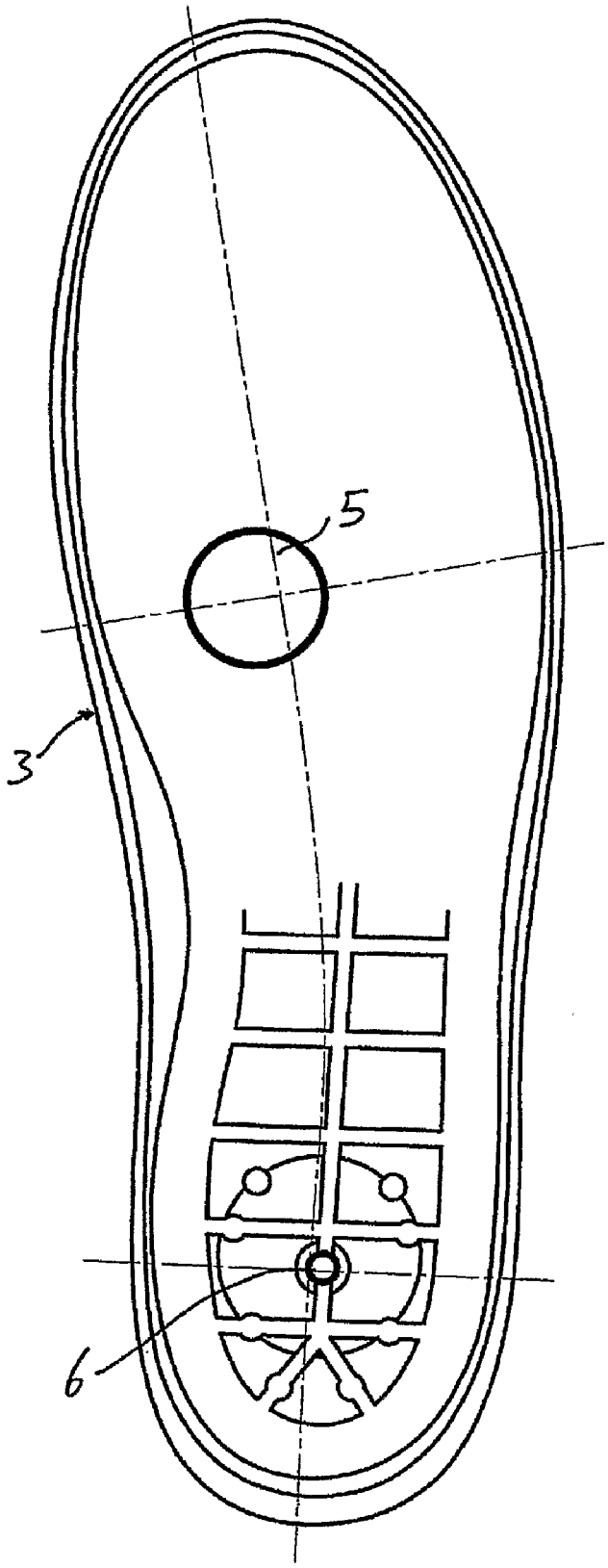
FIG..8

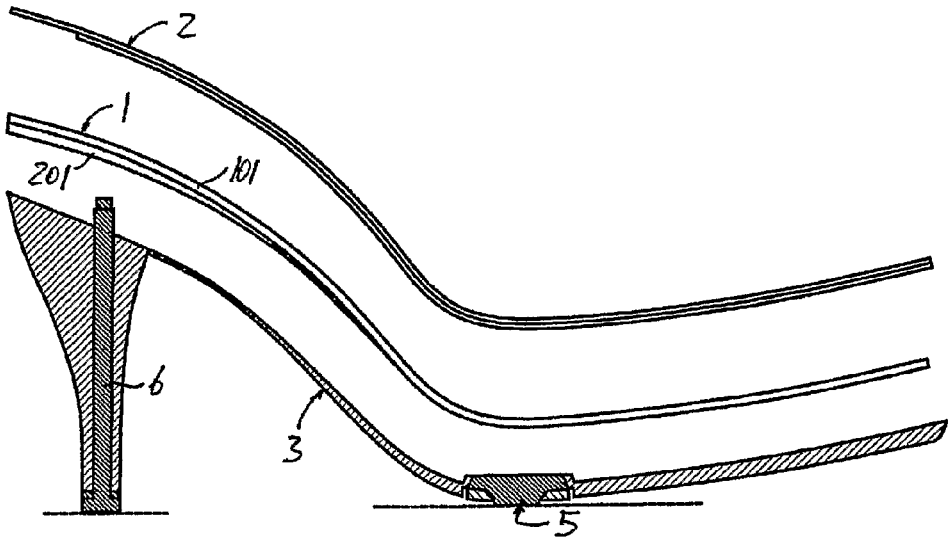
FIG..9
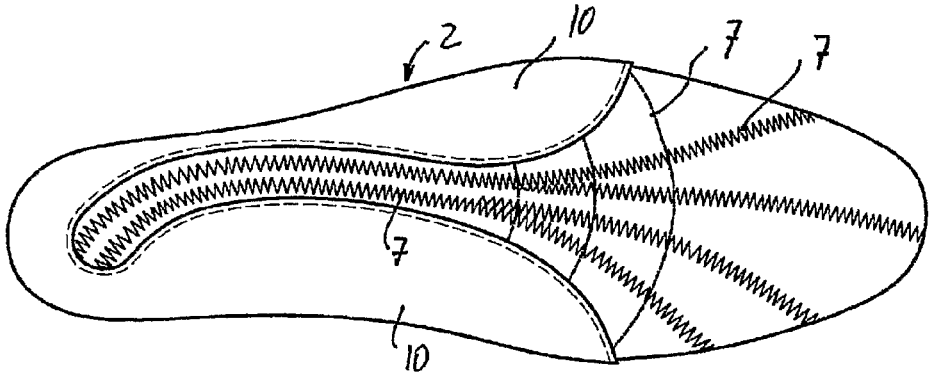
FIG..10
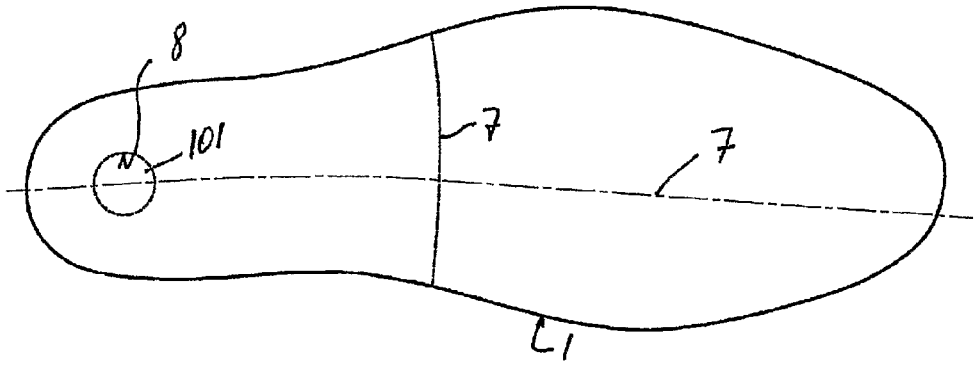
FIG..11

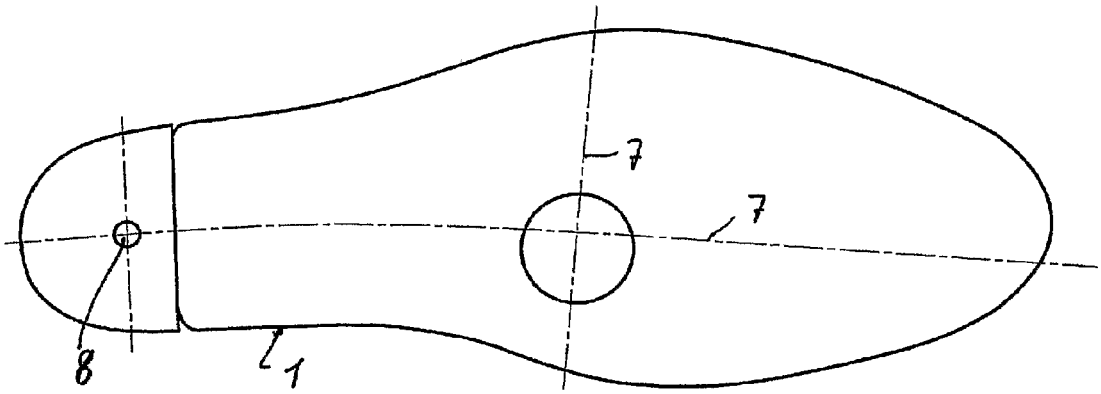
FIG..12
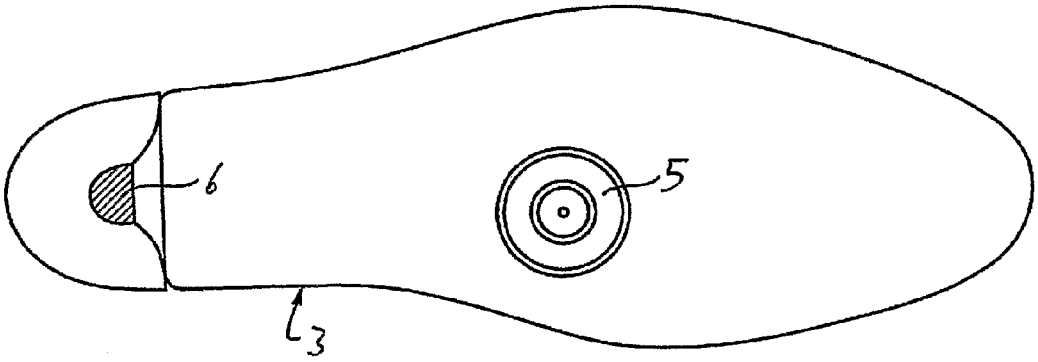
FIG..13
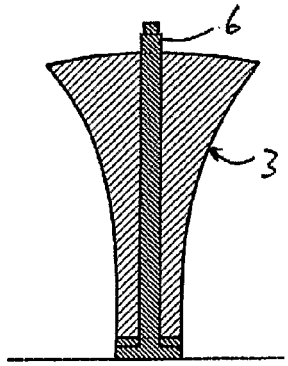
FIG..14

ANTISTATIC FOOTWEAR

BACKGROUND OF THE INVENTION

1. Field of the Invention

The present invention relates to antistatic footwear, and, more particularly, to antistatic footwear comprising an upper portion, an outer sole and an inner sole, also called insole, which is intended to overlap the sole side internal to the footwear and which is interposed between said outer sole and the user's foot. Electrical conductors passing through the sole provide for an electrical contact between the user foot and the ground.

2. Description of Related Art

Antistatic footwear is known and widely used. Although different types of antistatic footwear in the prior art accomplish their task satisfactorily, they also have some drawbacks.

Prior art antistatic footwear is often manufactured by embedding thin electrical conductors inside the sole, both in the foot tip region and in the heel region. These electrical conductors provide for a discharge to the ground of static electricity accumulated by a user. If the static electricity is not continuously discharged to the ground, the user may be affected by unpleasant shocks, for example when he touches metallic parts having a ground or earth electrical contact.

Prior art footwear has some drawbacks. Electrical conductors disposed in electrical contact with the user body and with the ground, for discharging the static electricity accumulated on the user, are often buried into rubber forming the sole. This entails very high manufacturing costs, since during manufacturing it is first necessary to prepare the antistatic conductor or thread interlacement and subsequently to perform the rubber casting.

Moreover, prior art antistatic soles typically include antistatic conductors or threads made of a metallic material. Metal threads or conductors involve a very low electrical resistance and, therefore, the risk is present that an electric charge on the ground is discharged on the user, causing a potential trouble situation and even a health danger if the voltage on the ground is sufficiently high for causing a step current, or a current passing through the user body for known reasons when the voltage between the feet of the user reaches a certain level. Typically, the step current is generated when the user is near an electrical cable that is in electrical contact with the ground because of an accident. Metal materials disposed inside conductors or threads of prior art soles may easily conduct step currents through the body of the user because of its low electrical resistance.

A further problem in the prior art is that antistatic threads or conductors are often uniformly arranged under the foot or on the sole surface. However, the foot does not rest completely and uniformly on the ground, and moreover during walking the foot exerts a pressure on the ground that is not uniform on all the surface of the support: there are indeed regions of support of the foot that are subject to a greater pressure and foot regions that are hardly submitted to the action of body weight and, therefore, that are not subject to weight pressure.

Since it is known that electrical conduction is highly dependent on the pressure between two bodies in contact one with the other, a person skilled in the art will understand that not all of the foot sole is in contact with the sole and so not all of the sole has the same electrical conductivity. This leads to the inevitable drawback of a different resistance in different portions of the foot sole and particularly there to a greater resistivity in foot regions submitted to a lower pressure. As a result, since electrical current flows always in the point of lowest resistance of a circuit, the electrostatic charge discharging from the foot to the ground preferably passes through determined foot regions, that is, those submitted to a greater pressure. Due to this phenomenon, small electrostatic charges are perceptible by the user when discharged to the ground.

The present invention aims at providing antistatic footwear of the type above described, in which drawbacks of known antistatic soles are overcome in a simple and inexpensive manner, while allowing for simpler and less expensive footwear manufacturing processes.

SUMMARY OF THE INVENTION

The present invention achieves the above aims by providing footwear, in which the insole comprises at least a region made of an electrically conducting material, and in which the outer sole comprises at least an antistatic, electrical conductor, forming a part of the sole and in electrical contact with the at least one insole region made of the antistatic, electrically conducting material. The antistatic, electrical conductor projects on the outer side of the sole in contact with the ground and extends into the inner side of the sole in contact with the corresponding electrically conducting region of the insole, thereby discharging static current from the foot to the ground. The antistatic electrical conductor of the sole includes an antistatic insert incorporated or embedded in said outer sole.

Typically, the sole has two electrically conducting inserts disposed in opposite end regions of the sole, that is, at the front and rear part of the foot, while the insole has a region made of an antistatic electrically conducting material that extends from one insert to the other, the two inserts being in electrical contact. In other embodiments, there are at least two separate regions made of an electrically conducting material, each one of the regions being provided with one of the electrically conducting sole inserts.

In one embodiment, the sole has an electrically conducting insert in the region corresponding to the tip and another electrically conducting insert in the heel region. In this embodiment, at least one region of the insole has one or more paths made of an electrically conducting material extending from one side of the insole to the other, and has surfaces in contact with the foot and with the corresponding electrically conducting sole insert.

Instead of or in addition to the above, electrical contact between the foot and the inserts may be obtained by connecting the foot by means of seams made of an electrically conducting thread disposed on the upper or lining of the footwear, which are in turn connected with the mounting insole. Generally, such connection between the mounting insole and the upper is made possible by the lower fastening interposition edge of the upper and lining between the mounting insole and the sole below. In this embodiment, seams made of an antistatic thread have to extend to the region of said lower edge interposing and fastening the upper to the sole and to the mounting insole.

Paths made of an electrically conducting material can be composed of seams made of an electrically conducting thread which seams pass from side to side of said insole and, advantageously, may be zigzag or toothed-shaped.

In addition to or instead of electrically conducting paths or electrically conducting seams, insole regions may be provided that are composed of continuous bidimensional surface parts.

Seams made of an electrically conductive thread may be provided, or electrically conductive paths may be arranged in at least two directions to provide a net of electrically conducting seams extending on all the insole or on certain regions of said insole. Such net may include, for example, one, two or more longitudinal seams made of an electrically conducting thread, and one, two or more transverse seams made of electrically conducting thread. In this embodiment, said longitudinal and transverse seams are arranged so to cross one with respect to the other, providing regions of mutual electrical contact.

Advantageously, a longitudinal seam or seams substantially extend without interruption from the tip to the heel of said insole, while transverse seams extend from one longitudinal side edge to the other longitudinal side edge.

A preferred embodiment provides for the insole to be composed of two layers that are separated one with respect to the other. One layer is referred to as mounting insole and the other layer is referred to as cleaning insole, each one of both layers being provided with regions made of an antistatic, electrically conducting material. At least part of these electrically conducting regions within the first layer coincide with the electrically conducting regions of the second layer. The mounting insole layer is interposed between the sole and the cleaning insole layer.

The mounting insole layer is intended to be firmly fastened to the sole side that is internal to the upper, while the cleaning insole layer may be merely inserted in the finished footwear so to overlap the mounting insole layer.

In this event, the cleaning insole layer has at least one region made of an electrically conductive material, or is provided with an electrically conductive material in direct contact with at least a region of the mounting insole that is made of an electrically conductive material, said region made of the electrically conductive material of the mounting insole being in direct contact with at least one sole insert made of an electrically conducting material. The cleaning insole layer is simultaneously in electrical contact through paths, seams or electrically conductive surface regions also with the foot of the user, so to provide an electrical connection between the foot and the ground or earth by means of the electrically conductive seams or paths or regions of two insole layers and of the inserts within the sole.

In a preferred embodiment, the sole has a first electrically conducting insert extending from side to side of said sole, in the medial region of the tip of said sole, and a second electrically conducting insert, extending from side to side of said sole, in the medial region of the heel. A first mounting insole layer is overlapped to the side of said sole internal to footwear.

The mounting insole typically includes two layers connected and overlapped one with respect to the other, of which an upper layer is made of an electrically conductive material and is opposite to the sole, and a lower layer, typically disposed in the rear half, that is in contact with the sole side opposite the ground and is made of a filling and/or cushioning material. Such lower layer is provided with a through opening in a location coinciding with one or more sole inserts made of an electrically conductive material such to allow the adhesion and the electrically conductive contact between said inserts and the upper layer (made of an electrically conductive material) of the mounting insole layer.

In order to overcome dangers related to high conductivity of electrically conductive parts, footwear according to the present invention provides that at least electrically conductive paths or threads and/or material in the mounting insole layer and/or electrically conductive inserts in the sole are made of an antistatic material, such as a synthetic non metallic material having a high electrical resistance, for example carbon fibers and/or fiber compounds comprising carbon fibers and/or carbon.

Advantages of the present invention are evident from the above description, and first consist of having an electrical contact between the user and the ground while avoiding the dangers of step currents. The present invention also provides for the easy replacement of insole parts without compromising antistatic properties. Further, the insole parts generate an electrical contact by simply resting one over the other and at the same time by compression due to the weight of the user. The location of sole inserts made of an electrically conductive material in the tip and heel regions, in typical points of support determined by foot anatomy and by walk patterns provides an electrical contact between foot and ground while preventing conditions wherein a static charge accumulates in the body of the user due to lack in the electrical contact between the sole and the ground. In these situations, the high electrical resistance of the conductors avoid that the possible ground discharge of the accumulated electrostatic charge takes place suddenly and with a well known unpleasant sensation.

As will be more clearly seen in the following disclosure, the arrangement and shape of the electrically conductive regions that are in electrical contact with the user foot is such to optimize electrical contact between said regions and the foot. Thus, the prior art drawback related to a better conductivity in foot regions having a greater pressure during walking is overcome. By arranging electrically conductive regions according to the present invention, a substantial resistance uniformity of the foot sole is achieved and the electrostatic charge transmitted from the foot to the ground is uniformly transmitted onto a larger portion of the foot, without concentrating in a single location. Thus, the drawback is overcome related to a preference region for current passage, which leads a user to perceive a problem when the static charge would be transmitted from the foot to the ground at the same location of the foot.

The use of antistatic materials, that is, conductors made of synthetic non metallic materials such as carbon fibers and/or fiber compounds comprising carbon fibers and/or carbon a provide for overcoming the prior art drawback related to high conductivity of metal materials. Carbon or fibers comprising carbon are current conductive, but have a resistance greater than metal, so that a static charge is progressively discharged onto the ground. While a metal material quickly discharges the static charge onto the ground, the static charge in the present invention progressively decreases over time while the sole contacts the ground. The user therefore does not perceive the discharge to the ground of the static charge and does not perceive problem situations. Thus, dangers related to the high conductivity of metal materials are overcome, since the step current must be very high to trigger an electrical charge from the ground to the user.

Further, footwear according to the present invention is easily manufacturable, which is adavantageously less expensive than for prior art soles. Antistatic threads or antistatic seams are made of carbon fiber, which can also be used to make seams that are usually disposed in the sole, preventing the embedding of antistatic conductors in s rubber cast soles. Moreover, the cleaning insole is produced with a simple, fast and inexpensive manufacturing process, and can be manufactured as an extractable and replaceable member that always provides antistatic properties. Such cleaning insole also may provide for an anatomic sockliner or an anatomic arch support that may be inserted in the footwear after the user has bought it.

The invention also relates to a sole for antistatic footwear, a cleaning insole for footwear, and an inner removable sockliner or arch support.

Further features and improvements are detailed in the appended claims.

BRIEF DESCRIPTION OF THE SEVERAL VIEWS OF THE DRAWINGS

Features of the invention and advantages derived therefrom will be more evident by the following detailed description and figures, in which:

FIG. 1 is a bottom view of a cleaning insole according to an embodiment of the invention.

FIG. 2 is a sectional view of the cleaning insole of FIG. 1.

FIG. 3 is a bottom view of a mounting insole according to an embodiment of the invention.

FIG. 4 is a sectional view of an outer sole according to an embodiment of the invention.

FIG. 5 is a bottom view of a sole according to an embodiment of the invention.

FIG. 6 is a sectional view of the sole of FIG. 5 having an insert in the foot sole region.

FIG. 7 is a sectional view of the sole outer member of FIG. 5 having an insert in the foot heel region.

FIG. 8 is a top view of the inner part of the sole according to an embodiment of the invention.

FIG. 9 is a cross-sectional side view of a woman heeled-footwear with a sole according to an embodiment of the present invention.

FIG. 10 is a bottom view of a cleaning insole for woman footwear according to an embodiment of the present invention.

FIG. 11 is a bottom view of a mounting insole for woman footwear according to an embodiment of the present invention.

FIG. 12 is a bottom view of the inner part of mounting insole for woman footwear according to an embodiment of the present invention.

FIG. 13 is a plan view of a sole for woman footwear according to an embodiment of the present invention.

FIG. 14 illustrates an insert for high heel woman footwear according to an embodiment of the present invention.

DETAILED DESCRIPTION OF EMBODIMENTS OF THE INVENTION

It is well known that footwear typically includes a sole, an upper, a mounting insole overlapping the sole side internal to the upper, and a cleaning insole facing the foot intended to be housed inside the footwear. Generally, the term "insole" is used to define the above described two layers, the mounting insole that directly overlaps the inner side of the sole, and the cleaning insole that overlaps the mounting insole. The cleaning insole may be a layer extending through the entire area of the footwear defined by the upper, or may be an arch support, or a sockliner.

Cleaning insoles may be simply laid on the sole and on the mounting insole, or may be coupled to the sole and to the mounting insole.

Typically, the cleaning insole is simply laid on the mounting insole, while the mounting insole may be coupled to the sole, for example by gluing or by chemical/physical adhesion to the sole side internal to the upper, or may be sewn thereto.

FIGS. 1 and 2 illustrate the cleaning insole 2 disposed in accordance with an embodiment of the present invention. As it can be noted particularly in FIG. 1, the cleaning insole 2 has the same outer shape as the sole and is provided with a plurality of conductive paths shaped as seams 7 constituting a net that covers part of the total surface of the cleaning insole 2. The conductive paths may consist of zig-zag seams 7 extending in the longitudinal direction of the cleaning insole 2, from a central region of the heel portion, that is the portion intended to rest against the foot heel, to the region of the foot sole towards the tip of the cleaning insole 2. Seams 7 are made of an electrically conductive, non-metallic thread, and having a relatively high electrical resistance. Seams 7 have uncovered thread portions on both faces or sides of the cleaning insole 2. In the heel and medial regions of the cleaning insole 2, seams 7 extend substantially parallel one with respect to the other and along an insole region against which the foot sole region is intended to rest against the ground. In their longitudinal extension, approximately at the intermediate region, seams 7 branch off one with respect to the other, making a seam sheaf diverging in the region in which the insole enlarges following the natural enlargement of the foot sole. Seams 7 end at different locations of the peripheral edge of the insole tip.

Additional paths or seams 7 made of an electrically conductive material are provided, having transverse directions with respect to the longitudinal extension of the cleaning insole 2. Such seams or paths are spaced apart one with respect to the other and are curved with the concave side faced towards the heel end, constituting a net of electrically conductive paths or seams 7 located in the enlargement region of the cleaning insole 2 in the proximity of the insole tip. Longitudinal and transverse paths or seams 7, made of an electrically conductive material, are in electrically conductive contact one with the other and have electric contact portions generated by resting and compressing then threads of seams 7 upon both faces of the cleaning insole 2. At both sides of the region comprising longitudinal seams 7 in the heel region of the cleaning insole 2, there are provided two continuous and seamless side regions 10. Said two side band-shaped regions join at the region of the foot heel end, since electrically conductive paths or seams 7 end at a medial region of the heel portion of the cleaning insole 2.

The cleaning insole 2 is intended to overlap a mounting insole 1 shown by a top view in FIG. 3. The mounting insole 1 is intended to overlap the inner side of the sole 3. The mounting insole 1 consists of two layers 101, 201, more specifically, an upper layer 101 that is faced towards the cleaning insole 2, namely towards the foot, and a lower layer 201 overlapping the lower side of layer 101 at least partially. The upper layer 101 is made of an antistatic or electrically conductive material, for example, a plastic material with added carbon or other known antistatic compositions. About halfway in the longitudinal direction of the mounting insole 1, a transverse seam line or path 7 made of electrically conductive material can be inserted, in the region corresponding to the medial hollow of the foot, that is, at the narrowest region of the foot. In the tip or heel portion of the mounting insole 1, there is provided only the upper layer 101 made of antistatic or electrically conductive material, such to provide an electric contact continuity between two faces of the mounting insole 1 in this region. The heel region of the mounting insole 1 has a through opening 8 in the lower layer 201, in a medial position of the heel region, such to uncover on the lower side of the mounting insole 1 said lower side towards the corresponding insert 6 made of an electrically conductive material, and disposed in the foot heel region of the sole 3. Said through opening or slot in the lower layer 201 of the mounting insole 1 substantially coincides also with the medial region of the heel of the cleaning insole 2, in which electrically conductive paths or seams 7 are provided.

The sole 3 shown in FIGS. 4 to 8 is provided with two inserts made of an electrically conductive material extending through all the thickness of the sole 3. A first electrically conductive insert indicated by reference numeral 5 is provided in a medial location of the tip portion of the sole, coinciding with the tip portion (made of electrically conductive material) of the mounting insole 1. There is provided a second insert 6 in the heel portion of the sole 3 coinciding with the through opening 8 in the mounting insole 1 and having electrical contact with the paths or seams 7 made of an electrically conductive material and disposed in the cleaning insole 2.

Therefore, the electrical contact between the foot of the user and the ground occurs by overlapping the mounting insole 1 between the sole 3 and the cleaning insole 2. The foot of the user rests on seams 7 in the cleaning insole 2. Seams or paths 7 in the front tip region of the cleaning insole 2 rest in turn both against the tip and heel regions of the mounting insole 1, all along said mounting insole 1. Because the upper layer 101 is electrically conductive, a mutual electrical contact is generated between seams or paths 7 and said upper layer 101. The mounting insole 1, in particular, the upper layer 101, is intended to adhere through the slot 8 with the inner end of insert 5 and insert 6 that project on the ground side of the sole 3, therefore being in electrical contact with the ground, and generating electrical contact with the front tip region and with the rear heel region of the mounting insole 1. Thus, the foot of the user comes in electrical contact with the ground, and because antistatic not metallic materials are used, such electrical contact has a finite resistance but is quite extensive.

Inserts 5 and 6 are embedded in the sole 3, providing electrical contact between the ground and insoles 1 and 2, and have an enlarged head on the side of the sole 3 resting on the ground and/or on the side in contact with mounting insole 1.

Inserts 5, 6 can be incorporated in the sole 3 in different ways. When the sole is made of synthetic material, such as rubber or plastic or the like, or when it is includes synthetic materials coupled to natural materials such for example leather, inserts can be incorporated in the sole structure during a molding operation, for example by injection molding the plastic material composing the sole 3.

According to a further feature, inserts have radial enlargements or intermediate flanges embedded in the sole material, while at least one or more projections rest on the ground and/or on the corresponding insole.

Such projections may be for example three, one of which is coaxial with and the other ones eccentric form inserts 5, 6, as for example shown in FIG. 8. In another embodiment, such projections may consist of a central circular member surrounded by a peripheral annular, not antistatic member. This peripheral member is not always present and/or necessary, as shown in FIGS. 5 to 7.

The footwear according to the invention may consist of any footwear type, such as for example a sport and low-heeled footwear shown in FIGS. 1 to 8 or a woman's low or high-heeled footwear such as shown in FIGS. 9 to 14.

The manufacture of the footwear according to the invention is similar in the above described embodiments. The lower layer 201 of the mounting insole 1 may extend in the front tip region of said mounting insole 1, and in this event a through opening 8 may be provided in the tip region of the mounting insole 1 similar to the one in the heel region, so to generate an electrical contact of the upper layer 101 (made of electrically conductive material) with the electrically conductive insert 5 in the tip region of the sole 3.

Moreover, referring to the location of the insert 5 in the tip region of the sole 3, the insert 5 is not placed in the medial location of the sole, but substantially at the metatarsal-phalangeal joint, particularly in the area of the first metatarsus.

Considering foot anatomy and the location of inserts 5 and 6, it is noted that inserts 5, 6 are located in the foot heel and first metatarsus region, that is, in two of the main three points of support of the foot in static condition. In a dynamic condition, on the contrary, the foot rests on the region of the metatarsal-phalangeal joint, as well as on the first metatarsus region, providing electrical contact between foot and the ground even during walking.

It is to be noted even that the arrangement of electrically conductive paths 7 on the cleaning insole 2 conforms to foot anatomy, the net of paths or seams 7 being disposed such that electrically conductive threads or electrically conductive paths are arranged on all the surface of the front or tip portion of the cleaning insole, extending to all the region of support of the metatarsal-phalangeal joint, while in the rear region of the cleaning insole 2 paths or seams are concentrated in foot heel region. Moreover, the longitudinal and transverse extensions of electrically conductive paths or seams 7 cause a contact of paths or seams 7 with the foot to be generated even in case of anatomical anomalies that cause a greater support in regions that are intermediate or not coinciding with the metatarsal-phalangeal joint or with the foot heel.

According to the present invention, it is possible to combine electrical conductors contacting the foot and arranged along surfaces of support of the foot with localized and restricted regions contacting the ground and arranged in sole locations, in which the pressure action exerted by the foot on the ground is greatest.

In addition to the above advantages, it is to be noted that footwear according to the present invention enable the manufacture of the cleaning insole 2 with natural and non-natural materials, such as leather or other natural material, because said cleaning insole 2 is made electrically conductive with the addition of an antistatic thread that is simply sewn on the cleaning insole 2. The thread that is sewn on the cleaning insole 2 may be provided along predetermined or random routes, or it can be provided along routes covering all the insole surface, such as longitudinal routes parallel one with respect to the other, or transverse routes parallel one with respect to the other, or concentric routes extending on a course following the insole perimeter, or combinations of seams along routes crossing one with the other and making grids or nets. Due to this feature, natural materials can also be made antistatic without the need to embed therein antistatic materials of a different type, thus making electrically conductive regions contacting the foot and inserts of the sole 3. Manufacturing of seams is fast and inexpensive and, above, all the embedding time is shorter than that of a composite sole or than bonding portions to the insole that have antistatic or electrically conductive material features. Thus, even insole thickness can be kept to a minimum. That is, for example, of great importance in high-heeled woman footwear, where the sole in the regions of the foot arch and in the foot tip is very thin. An example of embodiments of the present invention related to high-heeled footwear is illustrated in FIGS. 9-14. The advantage of the present invention related to cost reductions is present even considering, for example, a replacement of the cleaning insole, or, for example, when a special arch support is desired.

What is claimed is:

1. An antistatic footwear comprising:

an upper portion;

an outer sole;

an insole interposed between the outer sole and the upper portion, the insole overlapping the outer sole and comprising a cleaning insole facing a foot of a user and a mounting insole, the mounting insole comprising, an upper layer facing the cleaning insole and having at least a region made from an antistatic, electrically conductive material, and a lower layer facing the outer sole, wherein one or more electrically conductive inserts are disposed in a predetermined region of the outer sole corresponding to a predetermined foot region and extend through the lower layer of the mounting insole to contact the upper layer of the mounting insole, and wherein a plurality of seams made from an electrically conductive thread extend from a front portion of the cleaning insole to a rear portion of the cleaning insole and through both faces of the cleaning insole to generate electric contact between the cleaning insole and the upper layer of the mounting insole, thereby discharging static current from the foot to the ground.

2. The footwear according to claim 1, wherein the one or more electrically conductive inserts comprise a first and a second electrically conductive inserts located in opposite end regions of the outer sole.

3. The according to claim 2, wherein the first electrically conductive insert is disposed in a region corresponding to a footwear tip, and wherein the second electrically conductive insert is disposed in a region corresponding to a footwear heel.

4. The footwear according to claim 1, wherein one or more of the seams are zig-zag shaped.

5. The footwear according to claim 1, wherein the seams are disposed in a patterns having two directions to provide a network extending on said insole.

6. The footwear according to claim 5, wherein the seams extend on the insole in a longitudinal and transverse pattern, and wherein the longitudinal and transverse pattern causes the longitudinal seams to be in electrical contact with the transverse seams.

7. The footwear according to claim 6, wherein the longitudinal seams extend substantially from a tip to a heel of said insole, and wherein the transverse seams extend from a longitudinal lateral edge to an opposite longitudinal lateral edge of said insole.

8. The footwear according to claim 1, wherein the mounting insole is in electrical contact with a first and a second electrically conductive inserts disposed in the outer sole (3), wherein the lower layer of the mounting insole includes an opening that enables a direct contact between the region made from the electrically conductive material of the upper layer of the mounting insole and the second electrically conductive insert.

9. The footwear according to claim 8, wherein the first and the second electrically conductive inserts are disposed one in a tip region of the outer sole and the other in a heel region of the outer sole.

10. The footwear according to claim 9, wherein the electrically conductive seams converge in a heel area of the cleaning insole and in a location overlapping the opening in the lower layer.

11. The footwear according to claim 10, wherein the region made from the seams in the cleaning insole provides uninterrupted electrical contact from the tip to the heel regions of the cleaning insole.

12. The footwear according to claim 11, wherein the region made of the electrically conducting material in the cleaning insole comprises a grid of the electrically conductive seams.

13. The footwear according to claim 12, wherein the grid comprises longitudinal seams extending from the heel region to the tip region of said cleaning insole, wherein the longitudinal seams are substantially parallel one with respect to the other in the heel region, and wherein the seams diverge one with respect to the other ending in the tip region.

14. The footwear according to claim 13, wherein the seams extend along lines of the cleaning insole layer corresponding to a support area of the foot in the cleaning insole.

15. The footwear according to claim 13, further comprising transverse seams made of an electrically conducting material that connect the longitudinal seams.

16. The footwear according to claim 15, wherein the transverse seams have curved shapes with concave sides facing the heel of the cleaning insole.

17. The footwear according to claim 8, wherein the first insert is located at the distal end of the outer sole.

18. The footwear according to claim 8, wherein the second insert is disposed in a tip region of the outer sole, and wherein the second insert has an overturned T shape that extends without electrical interruption through the heel from an external side to an internal side of the outer sole.

19. The footwear according to claim 8, wherein the seams are made of a non metallic material that comprises carbon.

20. The footwear according to claim 8, wherein the seams are in larger amount in the region corresponding to the foot tip and in lower amount in the region of the heel.

21. The footwear according to claim 8, wherein the seams branch off at essentially equal distances one from the other from the heel to the tip.

22. The footwear according to claim 8, wherein the cleaning insole comprises a seamless region that includes two wing regions longitudinally extending from the heel towards the tip of the cleaning insole and laterally surrounding the seams.

23. The footwear according to claim 8, wherein the mounting insole comprises a plurality of seams made of an electrically conductive thread.

24. The footwear according to claim 8, wherein the footwear is low-heeled.

25. The footwear according to acclaim 8, wherein the footwear is high-heeled.

26. The footwear according claim 8, wherein the first insert is placed substantially in a portion of the outer sole that coincides with the metatarsal-phalangeal joint of the foot.

27. The footwear according to claim 8, wherein the first and second inserts are one placed in a portion of the outer sole corresponding to the heel and the other in the region of the outer sole corresponding to the first metatarsus.

28. The footwear according to claim 8, wherein the seams are disposed on the insole in positions within a perimeter of the foot shape.

29. The footwear according to claim 28, wherein the seams are disposed in areas of the insole that correspond both to the metatarsal-phalangeal joint and to the heel of the foot, and in the areas adjacent to the metatarsal-phalangeal joint and the heel of the foot.

30. The footwear according to claim 28, wherein the seams are disposed in areas of the insole overlapping the first and second inserts.

31. A sole for antistatic footwear comprising:

an outer sole having one or more electrically conductive inserts placed at predetermined points of an outer sole surface and contacting the ground;

a mounting insole coupled to a side of said outer sole that faces the user's foot, wherein the mounting insole comprises one or more regions of an antistatic material in electrical contact with the inserts; and a cleaning insole comprising one or more electrically conductive regions formed by electrically conductive seams having threads that extend through the cleaning insole and that contact the mounting insole, wherein the mounting insole is interposed between the outer sole and the cleaning insole, and comprises an upper layer facing the cleaning insole and having at least a region made from an antistatic, electrically conductive material, and a lower layer facing the outer sole, wherein the one or more electrically conductive extend through the lower layer of the mounting insole to contact the upper layer of the mounting insole, and wherein the electrically conductive seams generate electric contact between the cleaning insole and the upper layer of the mounting insole, thereby discharging static current from the foot to the ground.

32. The sole according to claim 31, wherein the seams are disposed in a region of the cleaning insole that extends from tip to the heel regions of the cleaning insole.

33. The sole of claim 32, wherein the seams are disposed on the cleaning insole to form a net of the electrically conductive threads.

34. The sole according to claim 33, wherein the net has longitudinal seams extending from the heel region to the tip region of said cleaning insole, and wherein the seams are substantially parallel one with respect to the other in the heel region and diverge one with respect to the other in the tip region of the cleaning insole.

35. The sole according to claim 31, wherein the electrically conductive seams extend along lines in the cleaning insole corresponding to regions of support of the foot.

36. The sole according to claim 31, wherein some of the seams are disposed longitudinally along the cleaning insole and intersect other seams disposed transversally on the cleaning insole, thereby creating electrical contact between the longitudinally and transversally disposed seams.

37. The sole according to claim 36, wherein the seams disposed transversally are curved with a concave side facing the heel of the cleaning insole.

38. The sole according to claim 31, wherein the seams are disposed in larger amount in a region corresponding to the foot tip, and in a lower amount in a region corresponding to the foot heel.

39. The sole according to claim 31, wherein the seams branch off evenly as the seams extends from a heel region to a tip region of the cleaning insole.

40. The sole of claim 31, wherein the cleaning insole comprises two regions longitudinally extending from the heel towards the tip regions of said cleaning insole, and wherein the two longitudinally extending regions are disposed laterally of the seams.

41. The sole according to claim 31, wherein the seams are disposed in a tip region to support the metatarsal-phalangeal joint and a foot heel region of the foot.

42. The sole according to claim 41, wherein the seams extends into portions of the cleaning insole that are adjacent to the portions corresponding to the metatarsal-phalangeal joint and heel of the foot, thereby providing electrical contact with the highest pressure regions of the foot even in an event of foot anomalies.

43. The sole according to claim 31, wherein the mounting insole comprises one or more electrically conductive regions that provide electrical contact between the mounting insole and the seams.

* * * * *